United States Patent [19]

Gannaway

[11] 4,059,366

[45] Nov. 22, 1977

[54] THERMAL OVERLOAD PROTECTIVE SYSTEM

[75] Inventor: Edwin L. Gannaway, Adrian, Mich.

[73] Assignee: Tecumseh Products Company, Tecumseh, Mich.

[21] Appl. No.: 670,646

[22] Filed: Mar. 26, 1976

[51] Int. Cl.[2] ..... F04B 49/06; F04B 49/10

[52] U.S. Cl. ..... 417/32; 417/564; 417/517; 417/902

[58] Field of Search ..... 417/32, 292, 571, 902, 417/564, 419; 136/230, 233; 137/516.13, 516.15, 516.17

[56] References Cited

U.S. PATENT DOCUMENTS

| | | | |
|---|---|---|---|
| 2,151,746 | 3/1939 | Cody | 417/571 X |
| 2,518,597 | 8/1950 | Brooks | 417/32 |
| 2,625,573 | 1/1963 | Connell | 136/230 |
| 3,110,089 | 11/1963 | Hill | 136/233 X |
| 3,278,111 | 10/1966 | Parker | 417/32 |
| 3,544,236 | 12/1970 | Brookmire | 417/32 |
| 3,592,061 | 7/1971 | Schwedland | 136/233 X |
| 3,877,837 | 4/1975 | Parker et al. | 417/32 X |

*Primary Examiner*—Carlton R. Croyle
*Assistant Examiner*—Leonard Smith
*Attorney, Agent, or Firm*—Albert L. Jeffers; Roger M. Rickert

[57] ABSTRACT

A system for protecting a machine against thermal overload, in particular, a compressor, and more particularly still, in respect of thermal protection of the valving of a compressor. The compressor is provided with a heat sensitive element in close proximity to the valving and in good heat exchange relation with gas passing through the valving, particularly, the gas being discharged through the valving. The heat sensitive element is connected in controlling relation to the drive motor for the compressor.

7 Claims, 5 Drawing Figures

THERMAL OVERLOAD PROTECTIVE SYSTEM

The present invention relates to a thermal overload protection system, and is particularly concerned with the use of such a system in connection with the valving of a compressor.

Thermal overload systems are known and usually comprise a temperature sensitive element disposed to be influenced by the temperature of the region to be protected with the temperature sensitive element being operative to, for example, control an electric circuit or the like which will initiate compensatory action. Such compensatory action, in the case of a compressor, may consist of turning off the compressor drive motor.

Such thermal overload protective systems, at least in connection with compressors, have heretofore disposed a temperature sensitive element directly in the flow path of the gas being compressed and this will, of course, involve the provision of a sealing arrangement in the vicinity of the heat sensitive element to prevent leakage of gas.

In the case of a PTC solid state sensing element, electrical terminal seals are expensive and introduce the liability of high pressure gas leakage.

With theeforegoing in mind, an object of the present invention is the provision of an effective temperature sensitive control system which eliminates the need for terminal seals and the like.

BRIEF SUMMARY OF THE INVENTION

According to the present invention, a machine, such as a compressor, is provided which receives at the inlet side a gas which is compressed and discharged from the output side. Such compressors sometimes develop extremely high pressures on the gas being discharged.

As a natural consequence of compressing the gas, the temperature thereof is elevated and the heated gases flow through the discharge valve, or valves, of the compressor and impart heat thereto. Should the discharge from the compressor become blocked or restricted for any reason, the pressure discharged will increase sharply and this will lead to an even sharper increase in temperature of the valving. Restricted air flow through the system condenser will also result in higher discharge gas pressures and temperatures. In addition, loss of control with respect to suction gas, temperature or pressure can cause damaging discharge gas temperatures.

The increase in temperature of the valving can result in valve failure, or piston seizures, as a result of the previously mentioned problems.

According to the present invention, a heat sensitive element, such as a thermistor, is installed in the body of at least one cylinder head of the compressor so as to be in good heat exchange relation with the gas being discharged from the compressor without, however, the thermistor being directly exposed to the gas flow.

The isolation of the heat sensitive element from the discharge gas flowing out of the compressor is accomplished by installing the thermistor in a blind hole or well formed in the cylinder head so that solid metal is interposed between the heat sensitive element and the gas being discharged from the compressor. Such an arrangement of the heat sensitive element eliminates the need for terminal seals between the heat sensitive element and the compressor discharge gas, and minimizes cost and leakage liabilities.

The heat sensitive element can be connected in any suitable manner with an electric control arrangement for controlling the energy supply to the electric drive motor for the compressor. In general, when the problems previously described arise, it is advantageous to shut down the compressor drive motor until the situation has been corrected.

The exact nature of the present invention will become more clearly apparent upon reference to the following detailed specification taken in connection with the accompanying drawings in which.

DETAILED DESCRIPTION OF THE INVENTION

Figure 1:
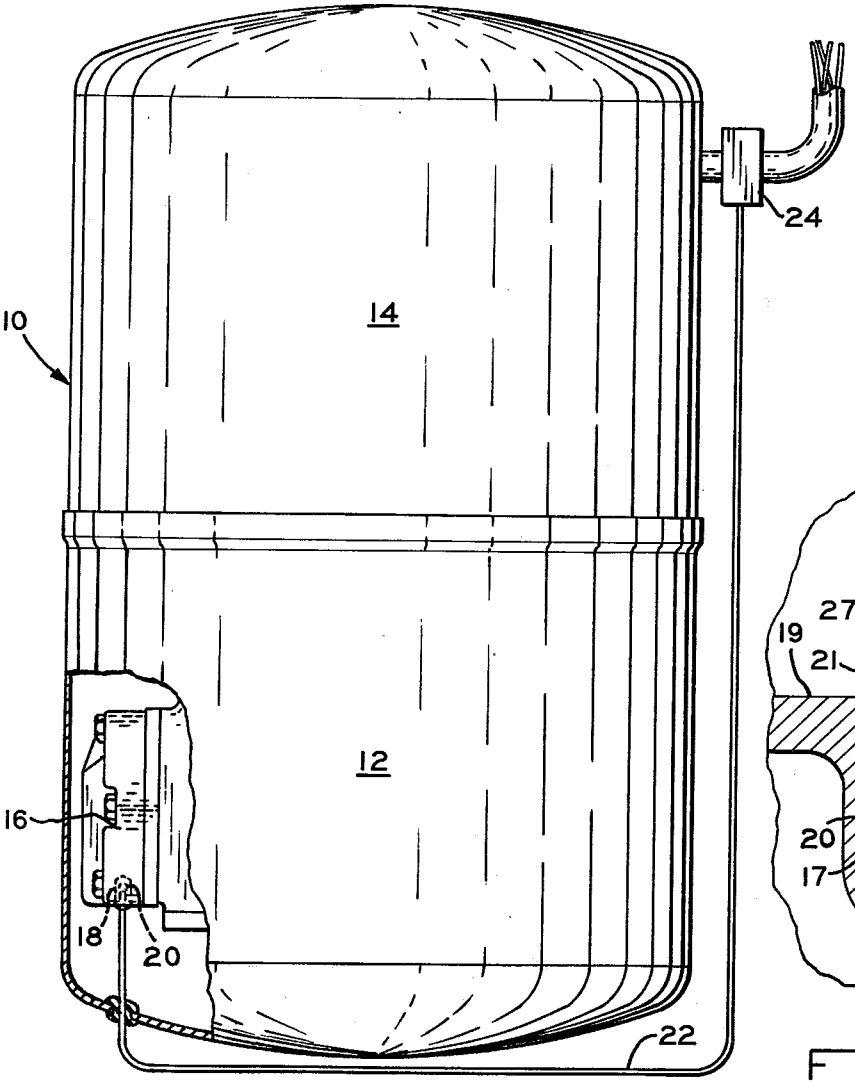
FIG. 1 is a side elevation view partly broken away of a compressor and drive motor combination.

Referring to the drawings somewhat more in detail, a motor driven compressor arrangement according to FIG. 1 may comprise an outer housing 10 in the upper housing 14 of which there is mounted the electric drive motor while in the lower housing 12 of which there may be mounted the compressor with the compressor consisting, for example, of four radial pistons displaced 90° from one another in the circumferential direction and likewise displaced axially from one another. Each piston is reciprocable in a respective cylinder and the outer end of each cylinder is closed by a respective valve plate and head assembly 16 having inlet and outlet passages for the gas being compressed by the compressor.

According to the present invention, at least one cylinder head is provided with a blind hole 18 bored therein into which is inserted a thermistor (PTC sensor) 20. This sensor is electrically connected by cable means 22 to control component 24 which controls the supply of energy to the drive motor.

Figure 2:
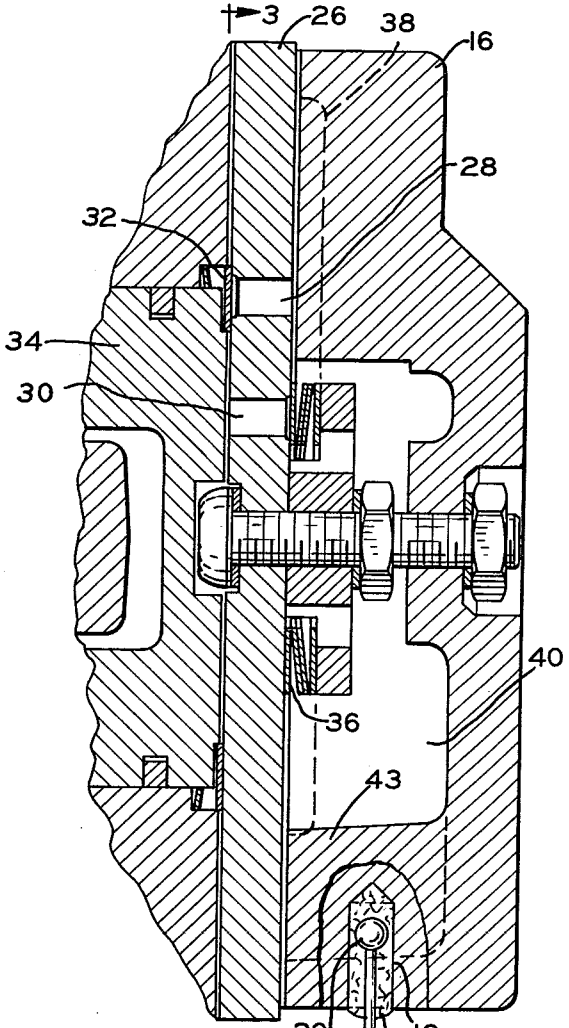
FIG. 2 is a view looking in at a cross-section of a valve and cylinder head assembly from the compressor side thereof.
Figure 3:
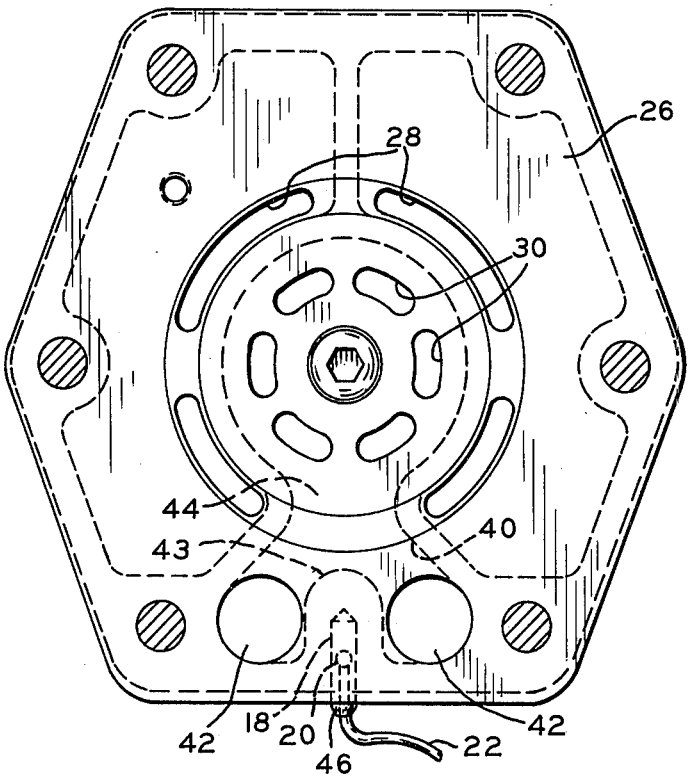
FIG. 3 is a vertical sectional view indicated by line 3—3 on FIG. 2 but showing also the valve porting to which the cylinder head and the valves therein pertain.
Figure 4:
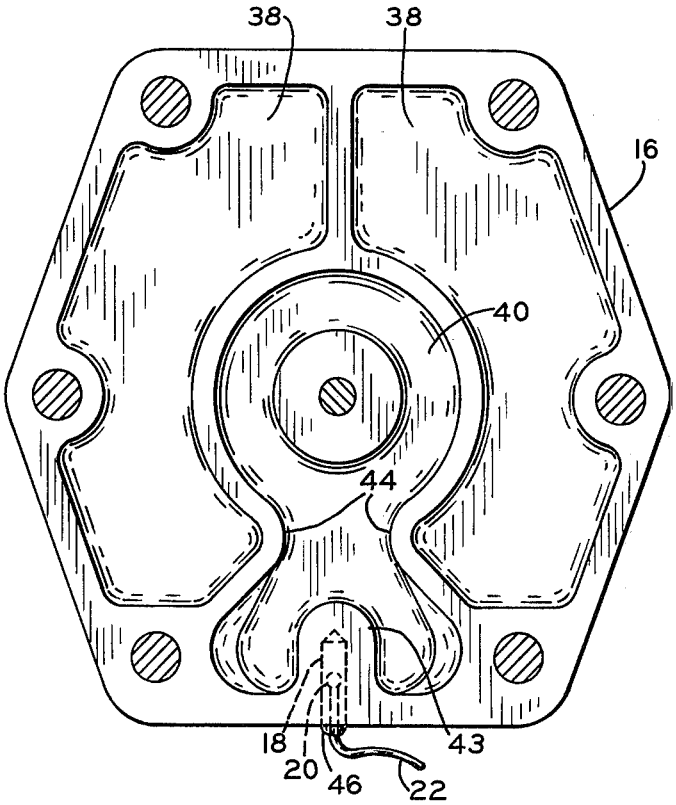
FIG. 4 is a view similar to FIG. 3 but with the valve plate removed and showing inlet and discharge valve cavities in elevation.

FIGS. 2 through 4 show details in respect of the cylinder head and the valving pertaining thereto. In FIG. 2, which is a view looking at the cylinder head and the valve plate from the compressor side, it will be seen that the valve plate, identified by reference numeral 26, has circumferentially distributed inlet ports 28 and inwardly therefrom the circumferentially distributed outlet ports 30.

As will be seen in FIG. 3, the inlet ports 28 are adapted for being closed by valve member means 32 when the pertaining piston, indicated at 34, is moving in the radially outward direction.

The outlet ports 30, on the other hand, are adapted for being closed on the side of the valve plate facing away from piston 34 by valve means 36 spring biased toward port closing position.

Passage means 38 formed in the cylinder head 16 communicates with inlet ports 28 whereas a further cavity 40 formed cylinder head 16 communicates with the downstream of outlet ports 42.

As will best be seen in FIGS. 2 and 4, the discharge cavity 40 communicates via ports 42 in valve plate 26 with discharge passage means of the compressor.

The valve body 16 includes a rib element 43 projecting into the cavity 40 at the bottom in the region of the cavity which is disposed laterally between ports 42 so that the discharge of gas from cavity 40 is divided by rib 43. Furthermore, the walls of cavity 40 constrict somewhat at 44 above rib 43 so that the gases being discharged from the compressor will tend to impinge on rib 43 and thereby to be in good heat exchange relation therewith.

The blind hole 18 is drilled into body 16 so as to extend into rib 43 as will best be seen in FIGS. 2, 3 and 4. The sensor 20 is then disposed in the blind hole, or wall, and the remaining space in the hole is filled with epoxy resin 46 or with some other material which will permanently hold the sensor in position while also placing the sensor in good heat exchange relation with rib 43.

In practice, since all of the pistons discharge into a common outlet channel, the provision of a sensor in one valve body or cylinder head only will suffice. It will be understood, however, that the placing of sensors in more than one of the heads is not precluded.

An advantage of the use of a sensing element as described herein and installed in the described manner is that leakproof electrical connections are not required between a high pressure passage and a low pressure region while, at the same time, the sensing element can be made to respond extremely rapidly to increases in temperature beyond the maximum desired.

The heat sensitive elements are compatable for series connection with similar motor protection elements and thereby permit a dual protective function of a common protection module.

In actual practice, a thermistor or sensor of the nature referred to may be only one-eighth inch in diameter, or even smaller, and the diameter of the well for receiving the element need be only a little larger sufficient to install the sensing element and to receive a material for holding the sensing element in place while establishing good thermal conductivity between the metal in which the well is drilled and the thermistor element.

Figure 5:
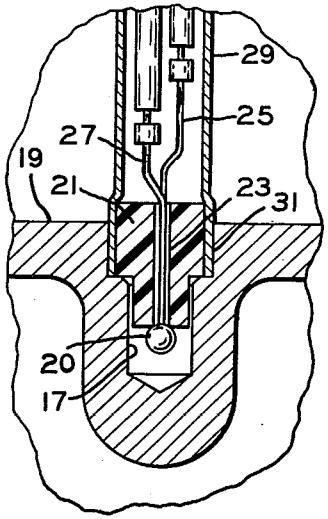
FIG. 5 is a cross-sectional view of a modification of the mounting of the thermistor in the cylinder head.

FIG. 5 illustrates a modification of the mounting of the thermistor 20 in a cylinder head. A blind hole 17 is provided in the cylinder head 19. A plastic plug 21 is provided with a center bore 23 for receiving the lead wires 25 and 27. A steel tube 29 having its end enlarged at 31 supports the plug by swedging and the thermistor 20 being larger in diameter than the center bore 23 will be held in a spaced relationship in the blind hole 17 formed in the cylinder head. The center bore 23 being smaller in diameter than the thermistor will also prevent the thermistor from backing into the tube 29.

By way of further comment on the sensor element, it has been mentioned that this element is preferably what is known in the trade as a "thermistor" which consists of a resistor element which responds sharply to temperature within a relatively limited but selectable temperature range. The characteristic of suddenly changing resistance makes the thermistor ideal for effecting initiating control influences at a well defined temperature with a minimum of delay.

Modifications may be made within the scope of the appended claims.

What is claimed is:

1. In a motor driven compressor having at least one piston reciprocable in a cylinder with a valve device closing the outer end of the cylinder, a cylinder head defining a discharge passage and including a rib protruding into said discharge passage and exposed to gas being discharged from the compressor, and discharge ports from said passage on opposite sides of said rib at the base thereof, a discharge valve interposed between the cylinder and the said passage, said discharge valve opening into said passage in a region spaced from the apex of said rib whereby the gas being discharged through said discharge valve flows along said rib from the apex down opposite lengths thereof to said discharge ports, a blind hole formed in said rib from the side of the head facing away from said passage, and a heat sensitive element mounted in said hole and adapted for connection in controlling relation to the motor driving the compressor.

2. A motor driven compressor according to claim 1 which includes heat conductive material filling the space in said hole which surrounds said heat sensitive element and which material establishes good heat exchange relation between said element and the metal of the body adjacent thereto.

3. A motor driven compressor according to claim 1 in which said passage includes a restricted region therein between said discharge valve and the apex of said rib.

4. A motor driven compressor according to claim 1 in which said blind hole extends into said rib from the bottom of said rib toward the apex thereof and is about midway between the flanks of the rib.

5. A motor driven compressor according to claim 4 in which said rib extends axially the full depth of said passage and said blind hole is in about the middle of the length of said rib.

6. A motor driven compressor according to claim 1 wherein a plug having a center bore for receiving the lead wires to the heat sensitive element is mounted in the blind hole, said plug being positioned in the blind hole so that the heat sensitive element is spaced from the inner surface of the blind hole.

7. A motor driven compressor according to claim 6 wherein the center bore of the plug is smaller in diameter than the heat sensitive element so that the heat sensitive element is prevented from passing therethrough.

* * * * *